US009976402B2

(12) United States Patent
Flores et al.

(10) Patent No.: US 9,976,402 B2
(45) **Date of Patent: *May 22, 2018**

(54) METHOD AND SYSTEM FOR HYDRAULIC FRACTURE DIAGNOSIS WITH THE USE OF A COILED TUBING DUAL ISOLATION SERVICE TOOL

(71) Applicant: Baker Hughes Incorporated, Houston, TX (US)

(72) Inventors: Juan Carlos Flores, The Woodlands, TX (US); Elton Frost, Jr., Spring, TX (US); Terrence Quinn, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 786 days.

This patent is subject to a terminal disclaimer.

(21) Appl. No.: 14/490,289

(22) Filed: Sep. 18, 2014

(65) Prior Publication Data

US 2016/0084056 A1 Mar. 24, 2016

(51) Int. Cl.
*E21B 43/26* (2006.01)
*E21B 47/06* (2012.01)
(Continued)

(52) U.S. Cl.
CPC ..... *E21B 43/26* (2013.01); *E21B 23/06* (2013.01); *E21B 33/124* (2013.01); *E21B 47/06* (2013.01); *E21B 49/008* (2013.01)

(58) Field of Classification Search
CPC ..... E21B 43/26; E21B 23/06; E21B 33/124; E21B 47/06; E21B 49/008
See application file for complete search history.

(56) References Cited

U.S. PATENT DOCUMENTS 3,577,781 A * 5/1971 Lebourg ..... E21B 47/06 166/264
4,962,815 A 10/1990 Schultz et al.
(Continued)

OTHER PUBLICATIONS

Korean Intellectual Property Office; International Searching Authority; International Search Report & Written Opinion for Application No. PCT/US2015/049230 dated Nov. 25, 2015.
(Continued)

*Primary Examiner* — Robert E Fuller
*Assistant Examiner* — Christopher J Sebesta
(74) *Attorney, Agent, or Firm* — Parsons Behle & Latimer

(57) ABSTRACT

A hydraulic fracture diagnostic system for reservoir evaluation of a high angle wellbore includes a coiled tubing string that extends from the surface to a location within a wellbore. The system includes a sensor and a pump connected to the coiled tubing string. A tool having at least two packing elements and a port positioned between the packing elements is connected to the coiled tubing string. The coiled tubing string positions the tool adjacent a fracture. The packing elements isolate the fracture and the port is configured to provide communication with the isolated portion of the wellbore. A diagnostic method includes pumping a volume of fluid from the isolated portion of a wellbore using a coiled tubing string and monitoring the pressure within the coiled tubing string. Pressure within the coiled tubing string may also be monitored after injection of fluid into the isolated wellbore through the coiled tubing string.

6 Claims, 6 Drawing Sheets

(51) Int. Cl.
*E21B 33/124* (2006.01)
*E21B 23/06* (2006.01)
*E21B 49/00* (2006.01)

(56) References Cited

U.S. PATENT DOCUMENTS 5,287,741 A 2/1994 Schultz et al.
5,435,395 A 7/1995 Connell
5,638,904 A * 6/1997 Misselbrook ..... E21B 17/203 166/384
5,743,334 A 4/1998 Nelson
6,325,146 B1 * 12/2001 Ringgenberg ..... E21B 21/002 166/186
7,059,407 B2 6/2006 Tolman et al.
7,066,283 B2 6/2006 Livingstone
7,980,306 B2 7/2011 Lovell et al.
8,015,869 B2 * 9/2011 Nold, III ..... E21B 49/008 73/152.51
8,210,257 B2 7/2012 Dusterhoft et al.
2003/0000707 A1 1/2003 Flowers et al.
2003/0037926 A1 2/2003 Sask
2003/0084715 A1 5/2003 Zazovsky
2003/0196815 A1 10/2003 Crawford et al.
2003/0230408 A1 * 12/2003 Acock ..... C09K 8/5756 166/297
2006/0000620 A1 1/2006 Hamilton
2006/0248949 A1 * 11/2006 Gregory ..... E21B 49/088 73/152.51
2007/0044960 A1 3/2007 Lovell et al.
2007/0062694 A1 3/2007 Ring et al.
2008/0053652 A1 * 3/2008 Corre ..... E21B 33/1243 166/179
2008/0110643 A1 * 5/2008 Richard ..... E21B 17/08 166/387
2009/0037112 A1 2/2009 Soliman et al.
2009/0164128 A1 6/2009 Tchakarov et al.
2009/0234584 A1 9/2009 Casey et al.
2010/0206548 A1 8/2010 Pisio et al.
2010/0258304 A1 10/2010 Hegeman
2011/0048122 A1 3/2011 Le Foll et al.
2011/0073210 A1 3/2011 Stretch
2011/0120702 A1 5/2011 Craig
2013/0118751 A1 * 5/2013 Landsiedel ..... E21B 33/1243 166/308.1
2013/0180722 A1 * 7/2013 Olarte Caro ..... E21B 43/26 166/308.1
2014/0238663 A1 8/2014 Neuwoudt et al.
2015/0075777 A1 3/2015 Walters et al.
2015/0167442 A1 6/2015 Harfoushian
2016/0084056 A1 3/2016 Flores et al.

OTHER PUBLICATIONS

US Patent and Trademark Office; Office Action for U.S. Appl. No. 14/495,793; dated Nov. 28, 2016.
Alain C. Gringarten, Resevoir Limit Testing for Fractured Wells, Oct. 1-3, 1978, Oct. 1, 1978.
Herber Cinco-Ley & Fernando Samaniego-V, Transient Pressure Analysis for Fractured Well, Journal of Petroleum Technology, Sep. 1981, Jun. 4, 1979.
W.J. Lee & S.A. Holditch, SPE 7929 Fracture Evaluation With Pressure Transient Testing in Low-Permeability Gas Reservoirs. Part I: Theoretical Background, May 20, 1979.
Dominique Bourdet and Alain C. Gringarten, SPE 9293 Determination of Fissure Volume and Block Size in Fractured Reservoirs by Type-Curve Analysis, Sep. 21, 1980.
US Patent and Trademark Office; Final Office Action issued in U.S. Appl. No. 14/495,793 dated Feb. 17, 2017.
US Patent and Trademark Office; Office Action issued in U.S. Appl. No. 14/495,793; dated Sep. 12, 2016.
US Patent and Trademark Office; Office Action; U.S. Appl. No. 14/495,793; dated May 5, 2017.
International Bureau of WIPO; International Preliminary Report on Patentability; International Application No. PCT/US2015/049202; dated Mar. 30, 2017.
US Patent and Trademark Office; Office Action; U.S. Appl. No. 14/495,793; dated Apr. 3, 2017.

* cited by examiner

METHOD AND SYSTEM FOR HYDRAULIC FRACTURE DIAGNOSIS WITH THE USE OF A COILED TUBING DUAL ISOLATION SERVICE TOOL

BACKGROUND

Field of the Disclosure

The embodiments described herein relate to a system and method for evaluating a production zone of a wellbore. The production zone is isolated by two isolating elements and a diagnostic of the formation and/or fracture may be done using coiled tubing in communication with the isolated production zone.

Description of the Related Art

Natural resources such as gas and oil may be recovered from subterranean formations using well-known techniques. For example, a horizontal wellbore, also referred to as a high angle well, may be drilled within the subterranean formation. After formation of the high angle wellbore, a string of pipe, e.g., casing, may be run or cemented into the wellbore. Hydrocarbons may then be produced from the high angle wellbore.

In an attempt to increase the production of hydrocarbons from the wellbore, the casing is perforated and fracturing fluid is pumped into the wellbore to fracture the subterranean formation. Hydraulic fracturing of a wellbore has been used for more than 60 years to increase the flow capacity of hydrocarbons from a wellbore. Hydraulic fracturing pumps fluids into the wellbore at high pressures and pumping rates so that the rock formation of the wellbore fails and forms a fracture to increase the hydrocarbon production from the formation by providing additional pathways through which reservoir fluids being produced can flow into the wellbore. An analysis of the near wellbore pressure may provide diagnostic information about the fracture, formation, and/or reservoir of hydrocarbons within the formation.

A production zone within a wellbore may have been previously fractured, but the prior hydraulic fracturing treatment may not have adequately stimulated the formation leading to insufficient production results. Even if the formation was adequately fractured, the production zone may no longer be producing at desired levels. Over an extended period of time, the production from a previously fractured high angle multizone wellbore may decrease below a minimum threshold level. The wellbore may be re-fractured in an attempt to increase the hydrocarbon production. An analysis of the near wellbore pressure before, during, and/or after the re-fracturing process may provide diagnostic information about the fracture, formation, and/or reservoir of hydrocarbons within the formation, or any wells in communication with the wellbore. Current diagnostic testing of high angle wellbores is limited to electrically conductive wire threaded in coiled tubing. It may be desirable to provide a tool and method of using pressure sensors and/or other sensors to provide diagnostic information about a high angle wellbore and the formation through which it traverses.

SUMMARY

The present disclosure is directed to a tool and method for obtaining diagnostic information about a fracture, formation, and/or reservoir of hydrocarbons and overcomes some of the problems and disadvantages discussed above.

One embodiment is a hydraulic fracture diagnostic system for well reservoir evaluation of a high angle wellbore comprising a coiled tubing string extending from a surface location to a downhole location within a wellbore. The system comprises at least one sensor connected to a portion of the coiled tubing string and at least one pump connected to the coiled tubing string. The system includes a downhole tool connected to the coiled tubing string being positioned adjacent a hydraulic fracture in a formation traversed by the wellbore. The downhole tool comprises a first packing element, a second packing element, and a port positioned between the first and second packing elements. The first and second packing elements may be actuated to isolate a hydraulic fracture. The port is configured to provide communication between the exterior of the downhole tool and the interior of the coiled tubing string.

The sensor of the system may be a pressure sensor. The pressure sensor may be located at the surface. The system may include a processor configured to determine at least one characteristic of the formation of the wellbore based on measurements from the at least one pressure sensor. The at least one pump may be configured to pump fluid down the interior of the coiled tubing string from the surface location and pump fluid up the interior of the coiled tubing string from the exterior of the downhole tool. The system may include a fluid having a predetermined density within the coiled tubing string.

One embodiment is a diagnostic method comprising displacing fluid within an interior of a coiled tubing string with fluid having a measured density and setting at least two packing elements to isolate a portion of a wellbore. The method comprises pumping a predetermined volume of fluid from the isolated portion of the wellbore into the interior of the coiled tubing string, monitoring a pressure within the coiled tubing string, and recording the change in pressure and time until the pressure within the coiled tubing string is stabilized.

The method may comprise injecting the predetermined volume of fluid into the isolated portion of the wellbore, the fluid being injected from the interior of the coiled tubing into the isolated portion of the wellbore. The isolated portion of the wellbore may include a fracture within a formation traversed by the wellbore. The method may comprise monitoring the pressure within the coiled tubing and recording the change in pressure over time until the pressure within the coiled tubing string is stabilized, after injecting the predetermined volume of fluid into the isolated portion of the wellbore. The method may comprise determining at least one characteristic of the formation traversed by the wellbore from the change in pressure over time. The method may include unsetting the two packing element. The method may include running a tool into the wellbore connected to the coiled tubing string prior to displacing fluid in the coiled tubing string, the tool comprising the at least two packing elements and a flow port in communication with the interior of the coiled tubing string positioned between the two packing elements. The method may include moving the tool to a second location within the wellbore to be isolated after unsetting the at least two packing elements.

One embodiment is a fracture diagnostic method comprising running a tool from a surface location to a downhole location in a wellbore, the tool being connected to a coiled tubing string and comprising at least two packing elements, the coiled tubing string extending from the surface to the downhole location. The method comprises setting the at least two packing elements to hydraulically isolate a portion of the wellbore at the downhole location and pumping treatment fluid down an interior of the coiled tubing string and out a port in the tool between the two packing elements to conduct a mini frac test of a formation traversed by the wellbore. The method comprises monitoring a pressure within the interior of the coiled tubing string and recording the change in pressure over time until the pressure within the interior of the coiled tubing string is stabilized.

The method may comprise pumping treatment fluid down the interior of the coiled tubing string for a determined amount of time to fracture the formation or enlarge a fracture of the formation at the downhole location. The method may comprise monitoring the pressure within the interior of the coiled tubing string during the pumping of treatment fluid down the interior of the coiled tubing string and recording the pressure readings until the pressure is stabilized within the coiled tubing string. The method may comprise determining at least one characteristic of the formation traversed by the wellbore from monitoring the pressure within the interior of the coiled tubing string. The downhole location may include a fracture in the formation that has been previously hydraulically fracture, wherein pumping treatment fluid down the interior of the coiled tubing string conducts a mini frac test of the previously fractured fracture. The method may include pumping treatment fluid down the interior of the coiled tubing string for a predetermined amount of time to re-fracture the previously hydraulically fractured fracture. The method may comprise monitoring the pressure within the interior of the coiled tubing string during the re-fracturing of the previously fractured fracture and recording the pressure readings until the pressure is stabilized within the interior of the coiled tubing string. The method may include determining at least one characteristic of the formation traversed by the wellbore from monitoring the pressure within the interior of the coiled tubing string.

Figure 1:
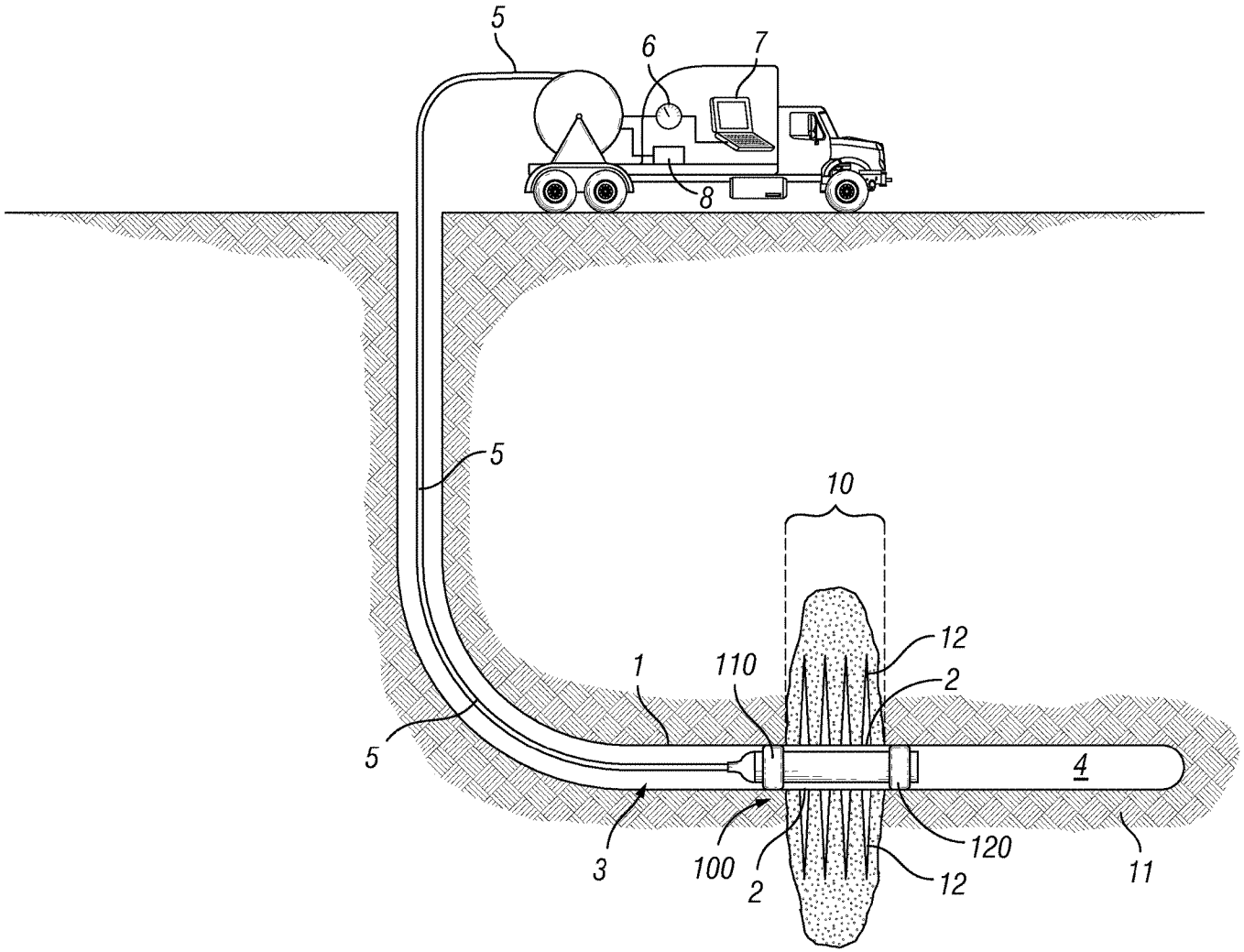
FIG. 1 shows an embodiment of a system that may be used for hydraulic fracture diagnostics.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows a downhole isolation tool 100 connected to a coiled tubing string 5, hereinafter referred to as coiled tubing, positioned within casing 1 of a horizontal or high angle wellbore, herein after referred to as a high angle wellbore. Coiled tubing 5 may be used to position the tool 100 within the high angle wellbore at a desired location as opposed to wireline, which cannot be used to position a tool within a high angle wellbore as would be appreciated by one of ordinary skill in the art. The tool 100 includes a first isolating element 110 and a second isolating element 120 that are actuated to isolate a first production zone 10 of the wellbore from the portion 4 of the wellbore downhole of the tool 100 and from the portion 3 of the wellbore uphole of the tool 100. The first production zone 10 may include at least one perforation 2 in the casing 1 and may include a plurality of perforations 2 in the casing 1 as shown in FIG. 1. The formation 11 may have been fractured 12 adjacent to the perforations within the production zone 10 as shown in FIG. 1. The number, size, and configuration of the fractures 12 and perforations 2 of a production zone may vary as would be appreciated by one of ordinary skill in the art.

Once a production zone 10 is isolated by the tool 100 from the rest of the wellbore, the coiled tubing 5 may be used for various diagnostic tests to determine various characteristics of the formation 11, fractures 12, and/or reservoir within the formation 11. The tool 100 includes a port 131 (shown in FIG. 2) located between the isolation elements 110 and 120 that permits fluid communication between the coiled tubing 5 and the isolated production zone 10. The coiled tubing 5 and tool 100 provide a hydraulic connection from the formation reservoir with the surface via port 131 in the tool 100. A pressure sensor 6 located at the surface may be used to monitor the pressure within the interior of the coiled tubing 5. The pressure sensor 6 may be connected to a computing device or any processor-based device 7 that may be used to analyze the pressure measurements and determine various characteristics of the formation 11, fractures 12, and/or reservoir within the formation 11. The pressure data from the pressure sensor 6 may be wirelessly transmitted to a processor-based device 7 located onsite or at a different location. The pressure data from the pressure sensor 6 may also be stored and/or record to be analyzed at a later date and/or at a different location. The pressure sensor 6 may be located within the wellbore and the data measured by the pressure sensor 6 may be recorded in memory for post operation analysis.

The change in pressure over time during various diagnostic tests may be used to determine various characteristics of the wellbore. For example, the tool 100 and coiled tubing 5 connected to a pump 8 and pressure sensor 6 may provide information about different flow regimes of the reservoir. It is generally understood by one of ordinary skill in the art that a hydraulically fractured producing well has at least three dominant flow regimes. One flow regime is the initial radial flow which is driven by the quasi-infinite conductivity and volume created artificially by the fracture. The initial radial flow regime may represent the volume created by the fracture to the stimulated permeability of the formation. Another flow regime is the linear flow driven by intrinsic permeability of the reservoir reaching through the fracture surface with the reservoir volume until it reaches the pressure front from an adjacent fracture. Yet another flow regime is the flow when the pressure drop disturbance reaches the top and bottom boundaries of the reservoir.

A transient pressure analysis of the near wellbore pressure of the isolated production zone 10 can potentially provide information on the characteristics of a stimulated reservoir volume in a short period of time. The coiled tubing 5 and port 131 in the downhole tool 100 provide a conduit from the surface to determine the transient near wellbore pressure. An analysis of the transient pressure analysis may provide reservoir and boundary information. A transient pressure analysis using an isolation tool 100 connected to coiled tubing 5, also referred to as the disclosed system, may be used for pre-fracture diagnostics, monitoring the reservoir during a fracturing or re-fracturing process, and/or monitoring the reservoir for a post fracture, or re-fracturing, evaluation. Monitoring the near wellbore pressure using the disclosed system may identify any skin factor on a fracture. During a re-fracture operation, the disclosed system may help to diagnose if a decline in production is mainly due to reservoir depletion of whether the decline in production is due to reduced conductivity by closing of the fracture, fine filling, formation damage, etc. The disclosed system may help re-fracture for previously fractured location to stimulate the fracture by increasing conductivity, increasing fracture length, increasing fracture width, and/or opening a new fracture in an undisturbed formation.

The downhole isolation tool 100 includes a first isolation element 110 and a second isolation element 120 that may be actuated to selectively isolate a portion of wellbore from the rest of the wellbore. A port 131 in the tool 100 permits fluid communication from the surface to the isolated portion of the wellbore via coiled tubing 5. Once the tool 100 is positioned at a desired location within the wellbore, the coiled tubing 5 may be filled with a diagnostic fluid. The diagnostic fluid may be a fluid having a specified density. Fluid contained within the coiled tubing 5 may need to be displaced out of the coiled tubing 5 upon filling the coiled tubing 5 with the diagnostic fluid. The coiled tubing 5 may convey the tool 100 into the wellbore with the diagnostic fluid already within the interior of the coiled tubing string. Since the properties of the diagnostic fluid are known, the diagnostic fluid may be used to determine properties of the wellbore, such as production flow rate from a fracture or fracture cluster, as described herein.

Figure 2:
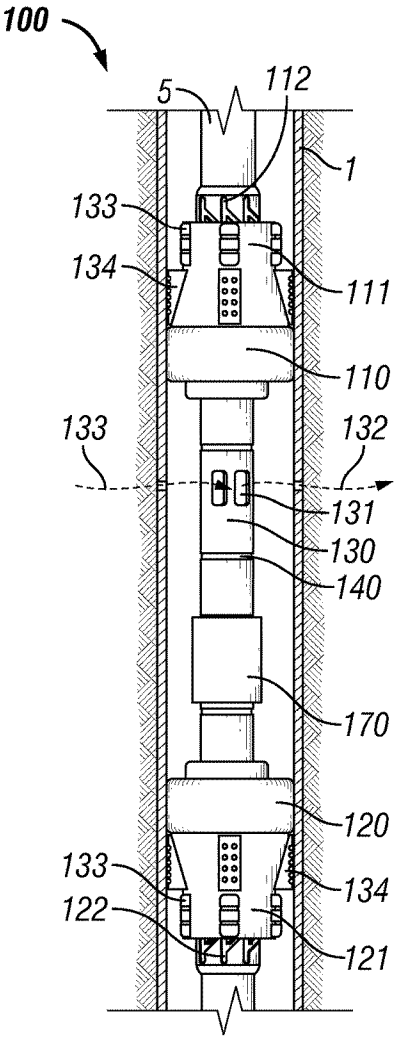
FIG. 2 shows an embodiment of a dual isolation tool that may be used for hydraulic fracture diagnostics.

The downhole isolation tool 100 may be one of various tools that allow for a portion of a wellbore to be isolate while permitting communication between the surface and the isolated wellbore. FIG. 2 shows an embodiment of the downhole tool 100 comprising one embodiment of a tool disclosed in U.S. patent application Ser. No. 14/318,952 entitled Synchronic Dual Packer filed on Jun. 30, 2014, which is incorporated by reference in its entirety. The isolation tool 100 may include pressure sensors as disclosed in U.S. patent application Ser. No. 14/318,952. The downhole pressure sensors may store pressure readings in memory to be analyzed after the tool 100 is removed from the wellbore. Alternatively, the downhole pressure sensors may transmit the pressure readings to the surface to be analyzed as discussed herein.

FIG. 2 shows an embodiment of a downhole isolation tool 100 having a first packing element 110 and a second packing element 120. The first packing element 110 may be an upper packer and the second packing element 120 may be a lower packer. The first and second packing elements 110 and 120 may each comprise a plurality of packing elements configured to create a seal between the tool 100 and casing 1, or tubing, of a wellbore. The downhole tool 100 is conveyed into the wellbore via a work string 5 and positioned at a desired location within the wellbore. The tool 100 includes a ported sub 130 having one or more flow ports 131 and a quick disconnect sub 140.

The second packing element 120 may be set in compression by the rotation of a sleeve or rotating sub 121 connected to the second packing element 120. The rotation of the sleeve or rotating sub 121 moves an element along a j-slot track 122 that actuates the second packing element between a set and unset state. The first packing element 110 may be set in tension by the rotation of a sleeve or rotating sub 111 connected to the first packing element 110. The rotation of the sleeve or rotating sub 111 moves an element along a j-slot track 112 that actuates the first packing element between a set and unset state as described herein. The downhole tool 100 may include a slip joint 170 positioned between the upper and lower packing elements 110 and 120. The slip joint 170 permits the lengthening of the distance between the lower packing element 120 and the upper packing element 110 while the upper packing element 110 is being set within the wellbore. The lengthening of the distance between the packing elements 110 and 120 may aid in preventing the lower packing element 120 from becoming unset during the setting of the upper packing element 110.

The setting of the first and second packing elements 110 and 120 hydraulically isolates the portion of the wellbore between the packing elements 110 and 120 from the rest of the wellbore. The downhole tool 100 may include drag blocks 133 and slips 134 to help retain the packing elements 110 and 120 in a set state within the casing 1.

The pump 8 at the surface may pump fluid down the coiled tubing 5 and out of the flow ports 131 of the ported sub 130 as shown by arrow 132 in FIG. 2. Likewise, fluid may be pumped out of the coiled tubing at the surface via pump 8 and fluid will flow from the formation and into the flow ports 131 of the ported sub 130 as shown by arrow 133. This permits the diagnostic testing and/or treatment of the fractures, formation, and reservoir as discussed herein. After a portion of the wellbore has been diagnosed and/or treated, the packing elements 110 and 120 may be unset and the tool 100 may be moved to another location within the wellbore.

Figure 3:
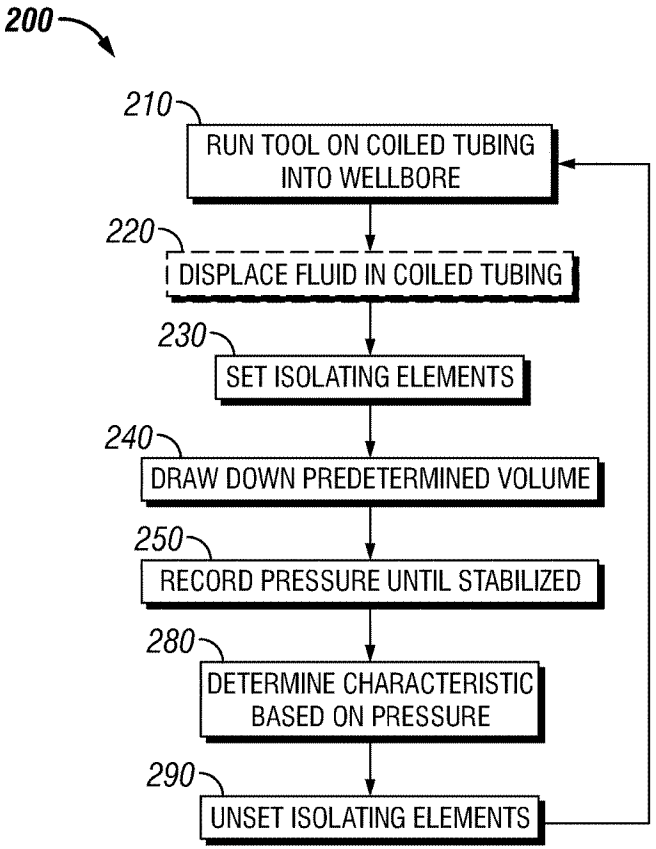
FIG. 3 shows a flow chart of an embodiment of a drawdown diagnostic method.

FIG. 3 shows a flow chart of one diagnostic method 200 using a dual isolation tool 100 to isolate a portion of a wellbore. In step 210 of method 200, an isolation tool is run into a high angle wellbore using coiled tubing 5. The coiled tubing 5 is used to locate the tool 100 adjacent a portion of the high angle wellbore, such as a production zone 10, that is to be isolated so that diagnostic testing can be performed. In optional step 220 of method 200, the fluid in the coiled tubing 5 is displaced with a diagnostic fluid having a known density. An example of a diagnostic fluid is fresh water having a density of 8.34 lbs/gallon. However, any fluid with a known density may be used as a diagnostic fluid as would be recognized by one of ordinary skill in the art having the benefit of this disclosure. Step 220 is optional as the diagnostic fluid may already be contained in the coiled tubing 5 while the tool 100 is run into the high angle wellbore.

The isolating elements 110 and 120 of the tool 100 are then set to isolate a portion of the high angle wellbore in step 230 of method 200. A predetermined volume of diagnostic fluid may then be removed from the coiled tubing 5 via the surface pump 8 in step 240. In the draw down step 240, a volume of fluid is being removed from the isolated wellbore by being pumped into the interior of the coiled tubing 5. A corresponding amount of volume of fluid will be removed from the coiled tubing at the surface. In step 250 of method 200, the transient fluid pressure in the coiled tubing 5 will then be monitored and recorded over time until the pressure has stabilized. In step 280, the transient pressures during the draw down step may be plotted over time using a computing device 7 to determine various properties of the wellbore such as fracture length, fracture width, production pressure of the reservoir, and the amount of fluid within the reservoir. After the diagnostic testing, the isolating elements are unset in step 290 and the tool 100 may be moved to another location within the high angle wellbore via the coiled tubing 5.

Figure 4:
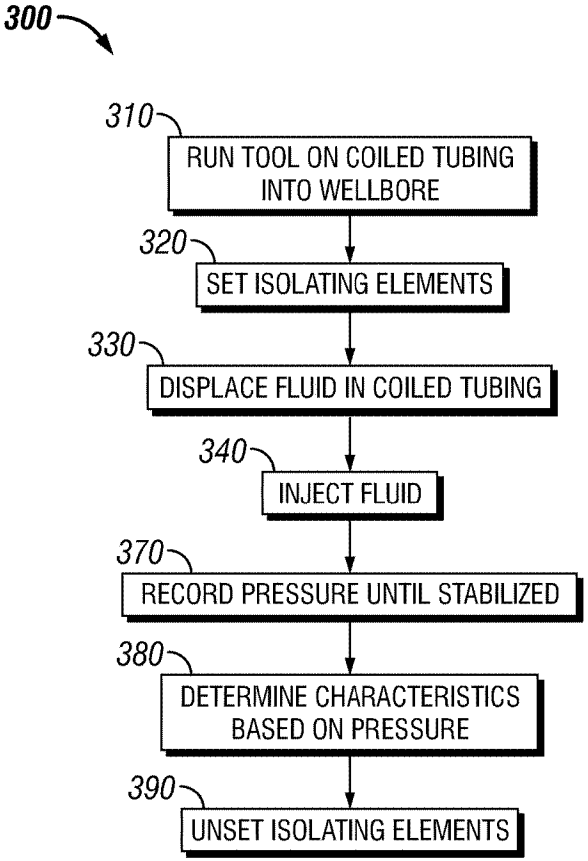
FIG. 4 shows a flow chart of an embodiment of an injectivity diagnostic method.

FIG. 4 shows a flow chart of one diagnostic method 300 using a dual isolation tool 100 to isolation a portion of a wellbore to evaluate the formation during a fracturing or re-fracturing operation. In step 310 of method 300, an isolation tool 100 is run into a high angle wellbore using coiled tubing 5. The coiled tubing 5 is used to locate the tool 100 adjacent a production zone 10 that is to be isolated so that diagnostic testing can be performed. The isolating elements 110 and 120 of the tool 100 are then set to isolate a portion of the high angle wellbore in step 320 of method 300. In step 330 of method 300, the fluid in the coiled tubing 5 is displaced with a diagnostic fluid having a known density. A predetermined volume of fluid is then injected into the isolated production zone by pumping fluid down the coiled tubing 5 via the surface pump 8 in step 340. In step 370, the fluid pressure in the coiled tubing 5 will then be monitored and recorded until the pressure within the interior of the coiled tubing string is stabilized. In step 380, the transient pressures may be plotted over time to determine various properties of the wellbore such as fracture length, fracture width, production pressure of the reservoir, and the amount of fluid within the reservoir. After the diagnostic testing, the isolating elements are unset in step 390 and the tool 100 may be moved to another location within the high angle wellbore via the coiled tubing 5.

Figure 5:
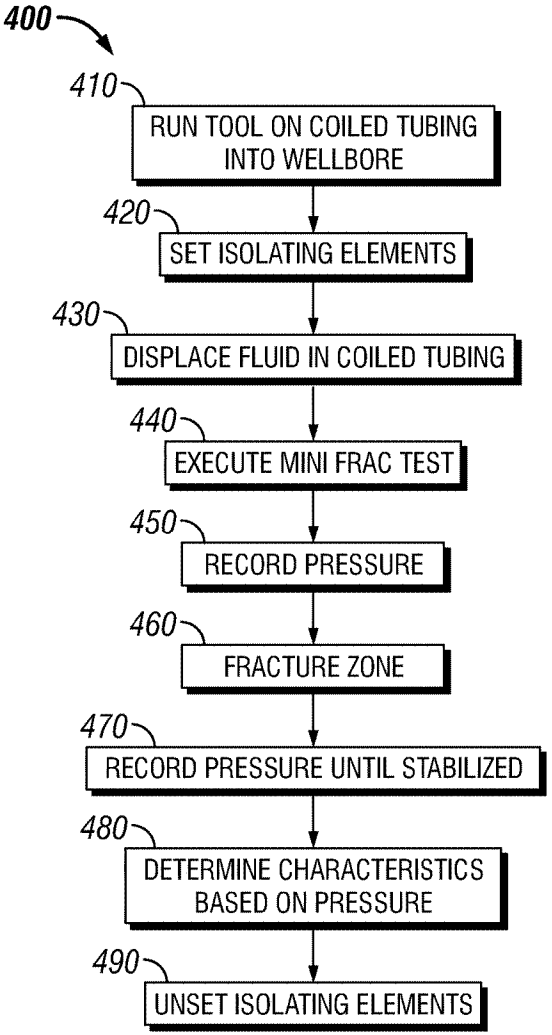
FIG. 5 shows a flow chart of an embodiment of a re-fracture with min-frac diagnostic method.

FIG. 5 shows a flow chart of one diagnostic method 400 using a dual isolation tool 100 to isolation a portion of a wellbore to evaluate the formation during a fracturing or re-fracturing operation. In step 410 of method 400, an isolation tool 100 is run into a high angle wellbore using coiled tubing 5. The coiled tubing 5 is used to locate the tool 100 adjacent a production zone 10 that is to be isolated so that diagnostic testing can be performed. The isolating elements 110 and 120 of the tool 100 are then set to isolate a portion of the high angle wellbore in step 420 of method 300. In step 430 of method 400, the fluid in the coiled tubing 5 is displaced with a diagnostic fluid having a known density. A "mini frac test" may then be performed by pumping fluid down the coiled tubing 5 via the surface pump 8 in step 440. A "mini frac test", as used herein, is the injection of the amount of fracturing fluid, without any proppant, in the amount of fluid that is just enough to open a fracture in the formation and measure the initial pressure required to open the fracture. In step 450 of method 400, the fluid pressure in the coiled tubing 5 is monitored and recorded during the "mini frac test" of step 440. The formation may then be fractured, or re-fractured if the location has been previously hydraulically fractured, during step 460 of method 400. In step 470, the fluid pressure in the coiled tubing 5 will be monitored and recorded during the fracturing procedure of step 460 until the pressure is stabilized. In step 480, the transient pressures during the "mini frac test" and the fracturing, or re-fracturing, operation may be plotted over time to determine various properties of the wellbore such as fracture length, fracture width, production pressure of the reservoir, and the amount of fluid within the reservoir. After the diagnostic testing, the isolating elements are unset in step 490 and the tool 100 may be moved to another location within the high angle wellbore via the coiled tubing 5.

Figure 6:
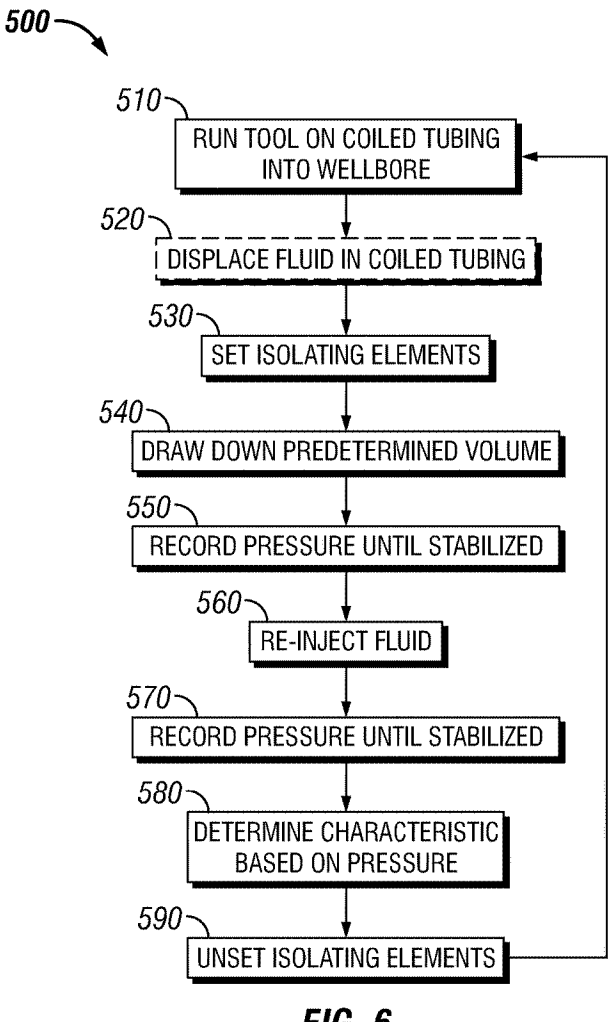
FIG. 6 shows a flow chart of an embodiment of a drawdown and injectivity diagnostic method.

FIG. 6 shows a flow chart of one diagnostic method 500 using a dual isolation tool 100 to isolate a portion of a wellbore. In step 510 of method 500, an isolation tool 100 is run into a high angle wellbore using coiled tubing 5. The coiled tubing 5 is used to locate the tool 100 adjacent a portion of the high angle wellbore, such as a production zone 10, that is to be isolated so that diagnostic testing can be performed. In optional step 520 of method 500, the fluid in the coiled tubing 5 is displaced with a diagnostic fluid having a known density. An example of a diagnostic fluid is fresh water having a density of 8.34 lbs/gallon. However, any fluid with a known density may be used as a diagnostic fluid as would be recognized by one of ordinary skill in the art having the benefit of this disclosure. Step 520 is optional as the diagnostic fluid may already be contained in the coiled tubing 5 while the tool 100 is run into the high angle wellbore.

The isolating elements 110 and 120 of the tool 100 are then set to isolate a portion of the high angle wellbore in step 530 of method 500. A predetermined volume of diagnostic fluid may then be removed from isolated portion of the high angle wellbore via the coiled tubing 5 and the surface pump 8 in draw down step 540. In step 550 of method 500, the transient fluid pressure within the interior of the coiled tubing 5 will then be monitored and recorded over time until the pressure has stabilized. The predetermined volume of diagnostic fluid will then be re-injected into the isolated portion of the wellbore via the coiled tubing 5 and surface pump 8 in step 560 and in step 570 the transient fluid pressure within the interior of the coiled tubing 5 will then be monitored and recorded over time until the pressure has stabilized. In step 580, the transient pressures during the draw down and re-injection steps may be plotted over time using a computing device 7 to determine various properties of the wellbore such as fracture length, fracture width, production pressure of the reservoir, and the amount of fluid within the reservoir. After the diagnostic testing, the isolating elements are unset in step 590 and the tool 100 may be moved to another location within the high angle wellbore via the coiled tubing 5.

Figure 7:
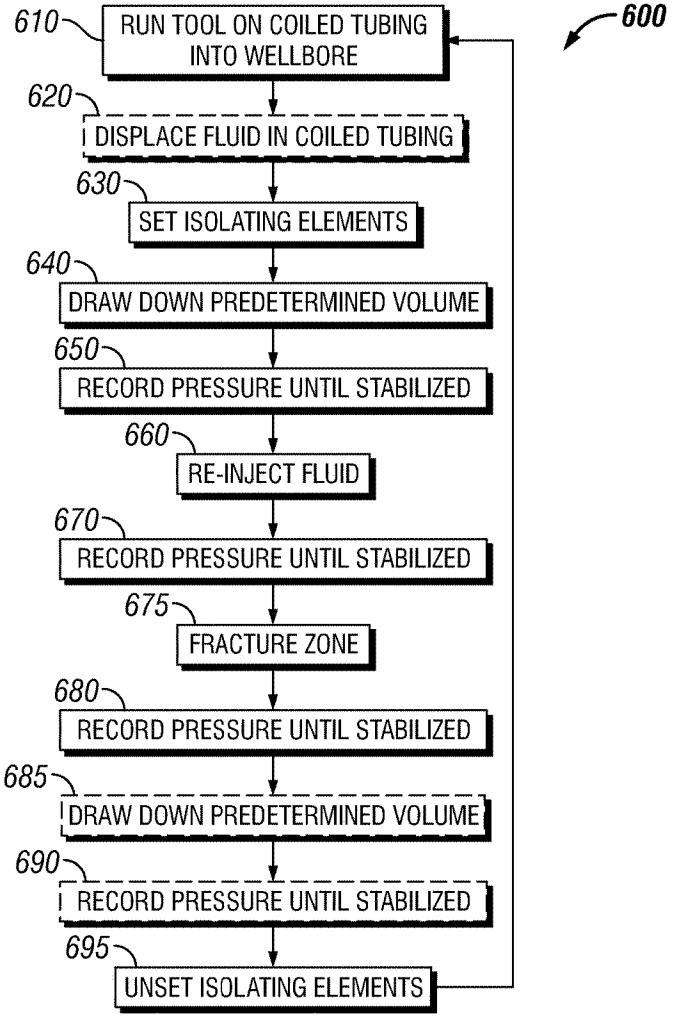
FIG. 7 shows a flow chart of an embodiment of a drawdown, injectivity, and re-fracture diagnostic method.

FIG. 7 shows a flow chart of one diagnostic method 600 using a dual isolation tool 100 to isolation a portion of a wellbore to evaluate the formation during a fracturing or re-fracturing operation. In step 610 of method 600, an isolation tool 100 is run into a high angle wellbore using coiled tubing 5. The coiled tubing 5 is used to locate the tool 100 adjacent a production zone 10 that is to be isolated so that diagnostic testing can be performed. In step 620 of method 600, the fluid in the coiled tubing 5 may be displaced with a diagnostic fluid having a known density. The step 620 of displacing the fluid with a diagnostic fluid is optional as the interior of the coiled tubing 5 may already be filled with a fluid having a known density. The isolating elements 110 and 120 of the tool 100 are then set to isolate a portion of the high angle wellbore in step 630 of method 600. A predetermined volume of diagnostic fluid may then be removed from isolated portion of the high angle wellbore via the coiled tubing 5 and the surface pump 8 in draw down step 640. In step 650 of method 600, the transient fluid pressure within the interior of the coiled tubing 5 will then be monitored and recorded over time until the pressure has stabilized.

A volume of fluid may then be re-injected into the isolated portion of the wellbore via the coiled tubing 8 and the surface pump in step 660. The re-injection of fluid may be a "mini frac test." In step 670 of method 600, the fluid pressure within the coiled tubing 5 is monitored and recorded during the re-injection step 660 until the pressure within the coiled tubing 5 has stabilized. The formation may then be fractured, or re-fracture if the location has been previously hydraulically fractured, during step 675 of method 600. In step 675, the fluid pressure within the coiled tubing 5 will be monitored and recorded during the fracturing procedure of step 660 until the pressure within the coiled tubing 5 has stabilized. Optionally, a second draw down step 685 may be done after the fracturing step 680 that pumps a determined volume of fluid from the isolated portion of the wellbore and the transient pressure within the coiled tubing may be monitored and recorded until the pressure stabilizes in optional step 690. The transient pressures within the coiled tubing during diagnostic testing may be plotted over time to determine various properties of the wellbore such as fracture length, fracture width, production pressure of the reservoir, and the amount of fluid within the reservoir. After the diagnostic testing, the isolating elements are unset in step 695 and the tool 100 may be moved to another location within the high angle wellbore via the coiled tubing 5.

Figure 8:
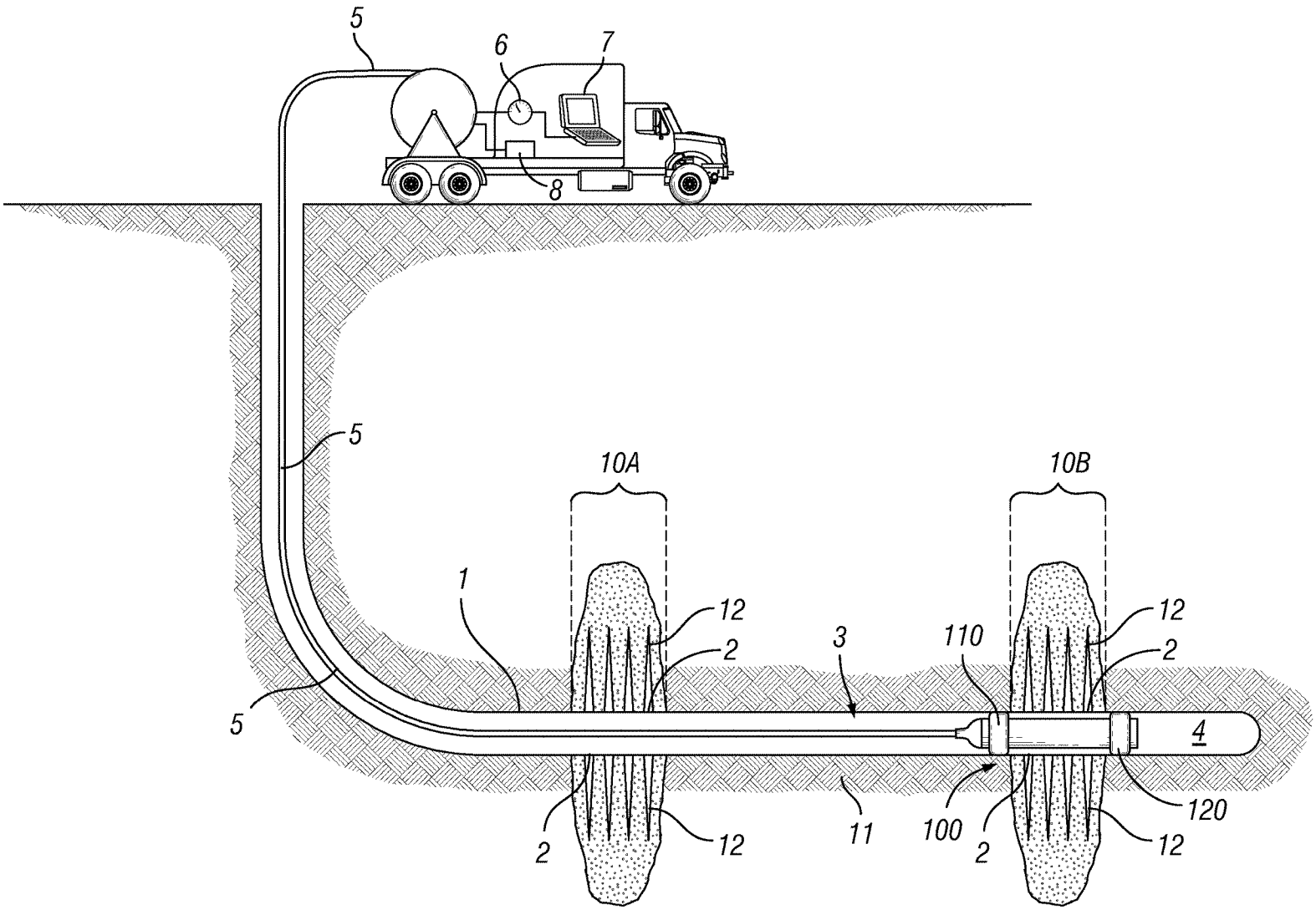
FIG. 8 shows an embodiment of a system that may be used for hydraulic fracture diagnostics.

FIG. 8 shows a downhole isolation tool 100 connected to coiled tubing 5 that has been positioned within casing 1 of a high angle wellbore adjacent a second production zone 10B. The downhole isolation tool 100 may have been moved to the second production zone 10B after diagnostic testing have been previously conducted on a first product zone 10A. The isolation elements 110 and 120 may be repeatedly actuated and deactivated so multiple locations along the length of a high angle wellbore may be isolated in sequence to permit diagnostic testing along a multizone high angle wellbore.

Figure 9:
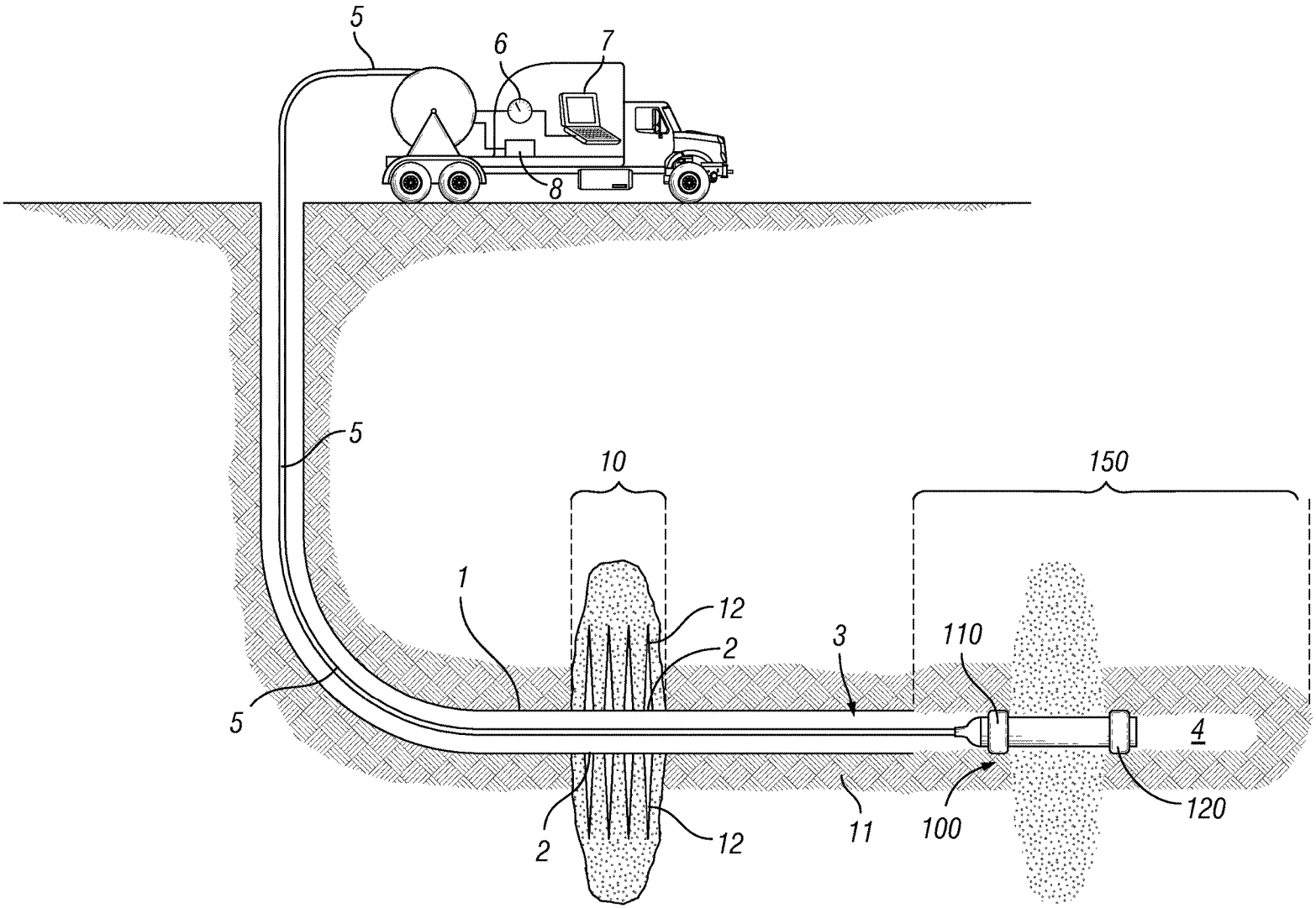
FIG. 9 shows an embodiment of a system that may be used for open hole diagnostics.

FIG. 9 shows a downhole isolation tool 100 connected to coiled tubing 5 that has been positioned within an openhole portion 150 of a high angle wellbore. The packing elements 110 and 120 of the downhole isolation tool 100 may have been actuated to seal a portion of the openhole portion 150 from the wellbore above 3 and below 4 the tool 100. The isolation elements 110 and 120 may be repeatedly actuated and deactivated so multiple locations along the length of a high angle wellbore may be isolated in sequence to permit diagnostic testing along a multizone high angle wellbore. The use of the isolation tool 100 in an openhole wellbore 150 may permit diagnostic testing of leak off to the formation. The interior of the coiled tubing 5 may be filled with a fluid having a known density and pressurized after the tool 100 has isolated a section of the openhole 150 wellbore. The monitoring of the transient pressure and/or amount of fluid loss from the interior of the coiled tubing over time may permit a determination of leak off to the formation.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. A diagnostic method comprising:

displacing fluid within an interior of a coiled tubing string with fluid having a measured density;

setting at least two packing elements to isolate a portion of a wellbore;

pumping a predetermined volume of fluid from the isolated portion of the wellbore into the interior of the coiled tubing string;

monitoring a pressure within the coiled tubing string;

recording a change in pressure and time until the pressure within the coiled tubing string is stabilized; and injecting the predetermined volume of fluid into the isolated portion of the wellbore, the fluid being injected from the interior of the coiled tubing into the isolated portion of the wellbore.

2. The diagnostic method of claim 1, further comprising monitoring the pressure within the coiled tubing string and recording the change in pressure over time until the pressure within the coiled tubing string is stabilized, after injecting the predetermined volume of fluid into the isolated portion of the wellbore.

3. The diagnostic method of claim 2, further comprising determining at least one characteristic of the formation traversed by the wellbore from the change in pressure over time.

4. The diagnostic method of claim 2, further comprising unsetting the two packing elements.

5. The diagnostic method of claim 4, further comprising running a tool into the wellbore connected to the coiled tubing string prior to displacing fluid in the coiled tubing string, the tool comprising the at least two packing elements and a flow port in communication with the interior of the coiled tubing string positioned between the at least two packing elements.

6. The diagnostic method of claim 5, further comprising moving the tool to a second location within the wellbore to be isolated after unsetting the at least two packing elements.

* * * * *